United States Patent [19]

Hammett

[11] 4,352,596

[45] Oct. 5, 1982

[54] STAB SYSTEM FOR EQUIPMENT REMOVAL

[75] Inventor: Dillard S. Hammett, Dallas, Tex.

[73] Assignee: Sedco, Inc., Dallas, Tex.

[21] Appl. No.: 89,186

[22] Filed: Oct. 29, 1979

[51] Int. Cl.[3] ..... E02B 17/00

[52] U.S. Cl. ..... 405/195; 52/236.3; 166/364; 405/211

[58] Field of Search ..... 405/195, 201, 204, 209, 405/211; 52/79.9, 236.3; 114/230, 249, 250, 252; 141/388; 166/364; 169/62, 69

[56] References Cited

U.S. PATENT DOCUMENTS

| | | | |
|---|---|---|---|
| 2,959,015 | 11/1960 | Beck | 405/209 |
| 3,609,981 | 10/1971 | Cook | 114/264 X |
| 3,722,452 | 3/1973 | Wynn | 114/249 X |
| 3,827,407 | 8/1974 | Stratienko | 114/249 |
| 3,949,699 | 4/1976 | Heese et al. | 114/249 |
| 4,206,782 | 6/1980 | Tuson | 141/388 X |
| 4,276,850 | 7/1981 | Valencia | 114/230 |

*Primary Examiner*—David H. Corbin

*Attorney, Agent, or Firm*—Hubbard, Thurman, Turner & Tucker

[57] ABSTRACT

A tear-away equipment removal system and method for use in controlling fires on offshore oil platforms. A preferred system includes a stab assembly connected to the end of the tension line and carried by a crane boom on a semi-submersible service vessel. A stab receptacle is provided in an outer wall of an offshore platform and is connected to large equipment units which block access to a fire site. The method includes maneuvering the service vessel and crane to allow connection of the stab assembly to the receptacle and the use of the tension line to physically tear open the outer wall of the structure and to remove the large equipment to provide clear access to the fire site.

4 Claims, 16 Drawing Figures

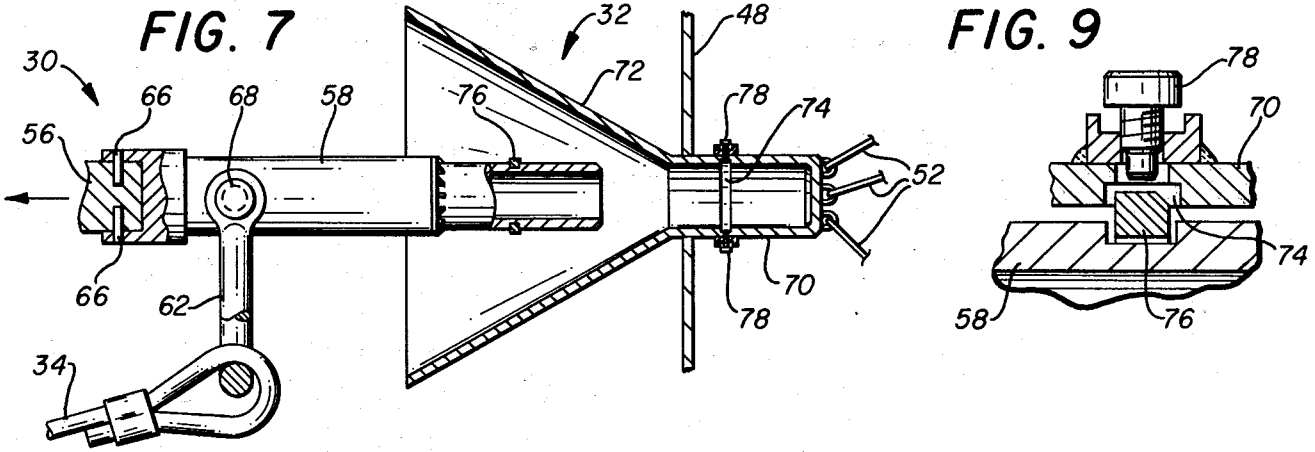
FIG. 9
FIG. 7
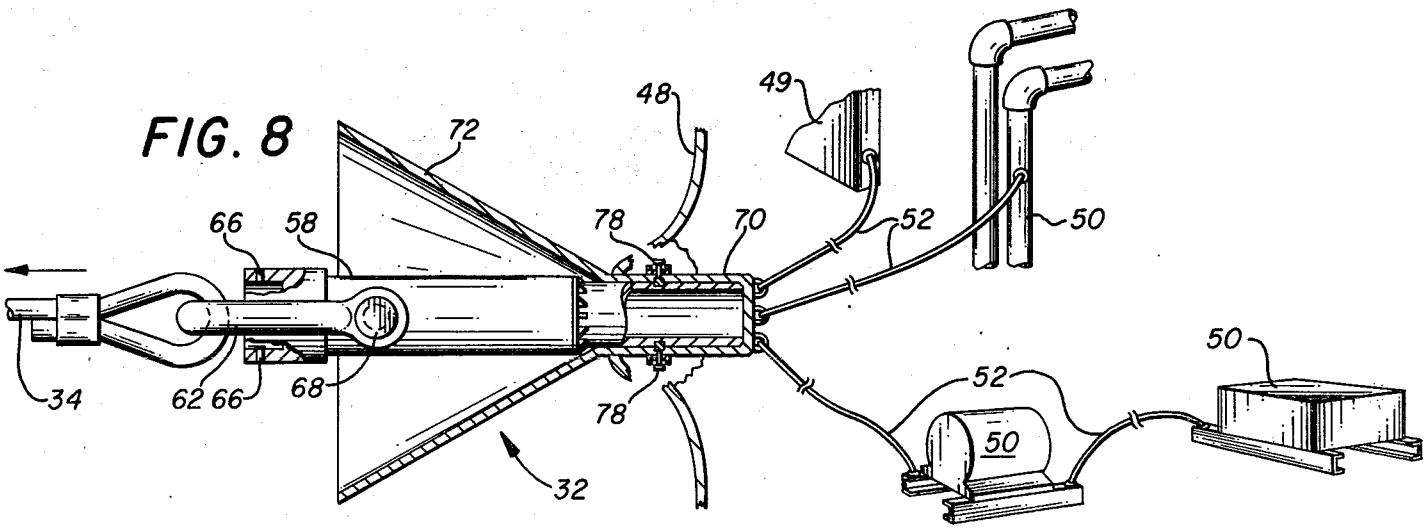
FIG. 8

STAB SYSTEM FOR EQUIPMENT REMOVAL

BACKGROUND OF THE INVENTION

This invention relates to equipment and methods for the emergency removal of equipment from offshore oil platforms for fire control purposes and more particularly to equipment and methods for using a service vessel for pulling outer walls and equipment from a platen to provide a clear path to a fire site.

Large quantities of hydrocarbons have been discovered and produced from offshore locations in various parts of the world. Such production provides a substantial part of the total world supply of hydrocarbons and is expected to provide even more in the future. Due to the increasing demand for hydrocarbons, the technology required for finding and producing oil in offshore locations has developed rapidly. Platforms are commonly designed for water depths of 500 feet or more and for hostile environments such as the North Sea. To justify the expense of building platforms in such environments, a large number of wells, for example 50 or more, must be drilled from each platform. As a result, large quantities of equipment must be concentrated around wellhead sites on the platforms and much of the equipment is enclosed in protective modules or rooms surrounding the wellhead sites. The platforms have in essence become large buildings, often five to six stories tall, supported on platform piers or legs, including living quarters and recreational areas for 100 or more workmen in addition to the work areas around the wellheads.

As with any other oil drilling operation, there is always a chance of a blowout or other disaster which can result in explosion, fire, and a loss of great quantities of hydrocarbons in addition to the possible injuries to the operating personnel. The problems of fighting a fire on an offshore oil well are compounded by the fact that the wellheads are totally surrounded by what amounts to a multistory building structure and large quantities of equipment which block access to the fire site. Upon occurrence of a blowout, all power on a platform is shut down to avoid starting a fire. If a fire does begin, it is essentially impossible to maintain power systems due to extensive damage. In any case, the personnel are evacuated from the platform as quickly as possible so that no one would be available to man fire fighting equipment even if power were available. While conventional fire fighting ships can spray water on a burning platform, this does little good unless a clear path to the fire site is provided. Fire fighters must have some type of vessel or platform provided near a burning platform since it is usually too dangerous to attempt to board the platform itself while a well is burning out of control. It can be seen that fire control from an adjacent work platform would be greatly facilitated by some means for providing a clear path to the wellheads. In addition, it can be seen that the clearing of a path to the fire site is preferably done as rapidly as possible and must be done from an adjacent work platform.

SUMMARY OF THE INVENTION

Accordingly, an object of the present invention is to provide a simple and rapid means for and method of clearing a path to an oil platform fire site.

Another object of the present invention is to provide means for tearing away an outer wall from an oil platform and removing large pieces of equipment blocking access to a fire site from a work platform adjacent to the oil platform.

These and other objects are achieved by providing a receptacle attached to an outer wall of an oil platform, tension means connecting said receptacle to large equipment units blocking a path between said outer wall and a wellhead site, means on a service vessel for attaching one end of a tension line to the platform receptacle, and means on the vessel for applying sufficient tension to the tension means to tear away a platform outer wall and to pull the large equipment units through the resulting opening thereby clearing a path to a fire site. In a preferred form, the platform receptacle is a stab receptacle having a conical guide and the vessel tension line is connected to a stab assembly carried on a crane boom which guides the stab assembly to the platform receptacle.

BRIEF DESCRIPTION OF THE DRAWINGS

The present invention may be better understood by reading the following description of the preferred embodiments with reference to the accompanying drawings wherein:

FIG. 7 is a cross sectional view of the stab assembly and receptacle of the present invention;

FIG. 8 is a detailed illustration of the stab assembly locked to the receptacle with both being pulled from the wall of the oil platform;

FIG. 9 is a cross sectional illustration of the ring arrangement which interlocks the stab assembly and the receptacle;

DESCRIPTION OF THE PREFERRED EMBODIMENT

Figure 1:
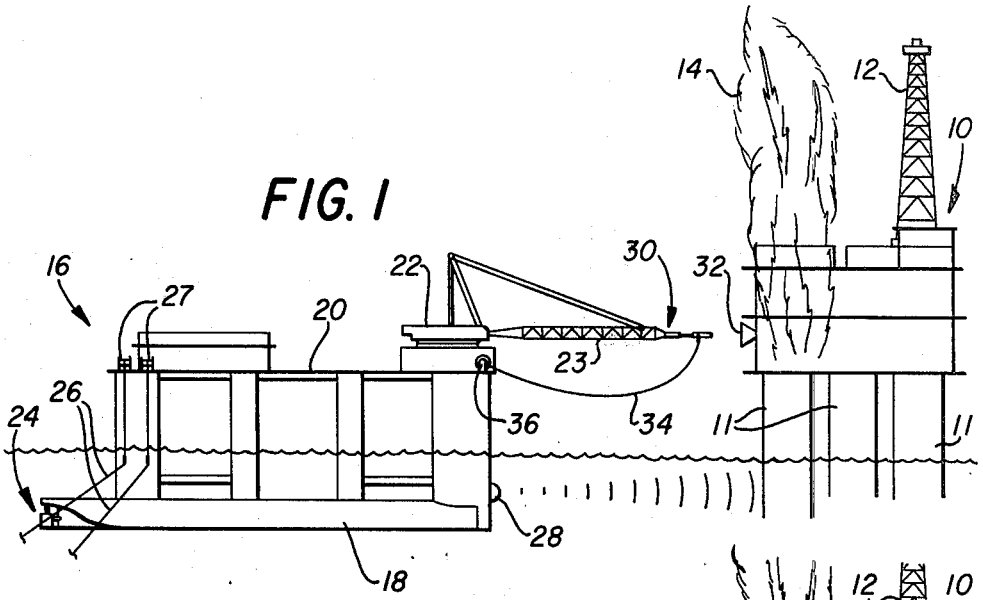
FIGS. 1 through 3 sequentially illustrate the guiding of a stab assembly on a semi-submersible vessel to a receptacle on an oil platform and the tearing away of an outer wall and equipment blocking a path to a wellhead fire on the platform.
Figure 2:
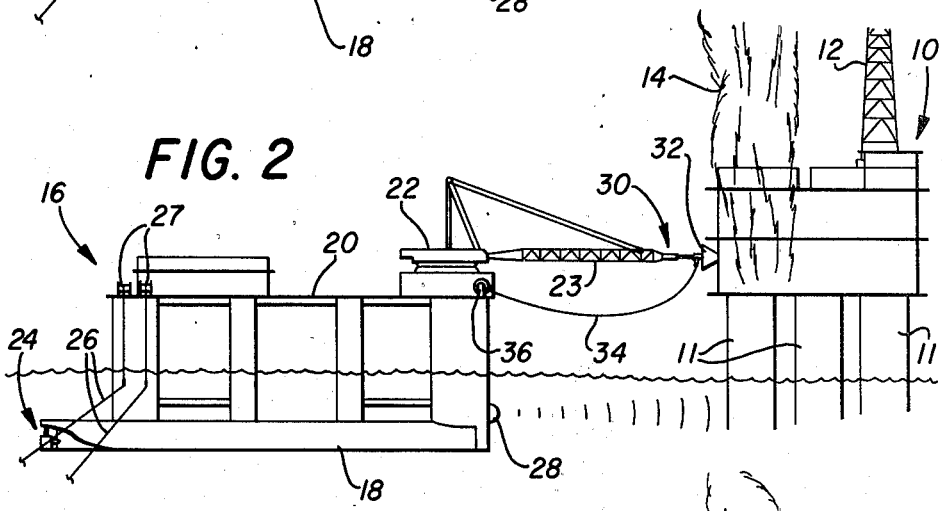
Figure 3:
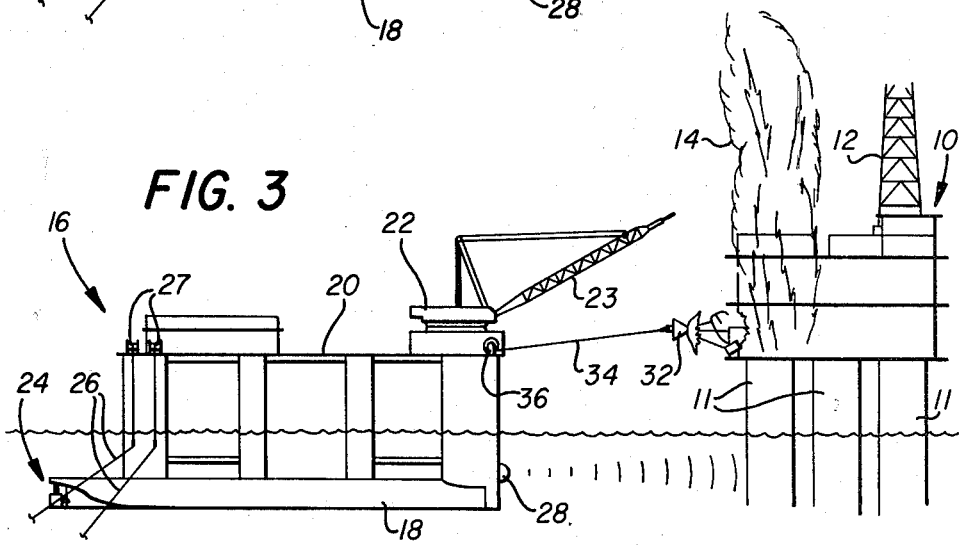

With reference now to FIGS. 1, 2 and 3, the basic components and operation of the present invention is sequentially illustrated. In each of these Figures, there is illustrated in simplified form an offshore oil platform 10 having three legs 11. The terms "offshore oil platform" or "oil platform" are intended to include any type of offshore platform whether primarily intended for drilling use, production use or otherwise. A derrick 12 is positioned over one of the legs through which wells are drilled. Flames and smoke 14 emanating from about another of the support legs 11 indicate that a blowout and fire have occurred. As noted above, such a fire can be effectively controlled only when a clear access path is provided to the wellhead site.

A semi-submersible service vessel 16 is shown anchored adjacent to the burning platform 10 and carries necessary fire fighting equipment. Vessel 16 is a semi-submersible vessel having an overall length of about 450 feet, a width of about 250 feet and a height from lower hull 18 to working deck 20 of about 150 feet. A heavy duty crane 22 is carried on the forward end of working deck 20. Crane 22 is preferably of the 350 ton class and is equipped with electronic motion compensators. The forward ends of the hulls 18 are preferably modified by not extending beyond the forward edge of working platform 20. This modification of hulls 18 allows vessel 16 to approach platform 10 very closely without fear of colliding with the platform support legs 11 below the water surface. Vessel 16 is preferably dynamically stabilized having side thrusters as well as main propulsion units 24. In addition, vessel 16 has at least a pair of anchoring systems including mooring lines 26 and retrieval means or winches 27. Vessel 16 also preferably carries distance measuring equipment, such as a sonar unit 28, on its forward end. The sonar unit 28 is used to accurately measure the distance between vessel 16 and platform 10. Such a distance measurement is needed for automatic control of dynamic positioning equipment.

As illustrated in FIG. 1, mooring lines 26 are connected to anchors which are deployed as vessel 16 approaches the platform 10. By using propulsion units 24 in combination with the mooring lines 26, the distance between vessel 16 and platform 10 can be closely controlled. This close control allows the positioning of a stab assembly 30 relative to a receptacle 32 attached to an outer wall of platform 10. As seen in FIG. 1, the assembly 30 is carried on the end of a boom 23 of crane 22 which provides a considerable reach, up to about 300 feet, from the forward end of vessel 16. A tension line 34 extends from the stab assembly 30 to a retrieval means or winch 36 on vessel 16.

In the FIG. 1 illustration, the stab assembly 30 is aligned with a receptacle 32. In the FIG. 2 illustration, the vessel 16 has moved forward until the assembly 30 has entered the conical guide of receptacle 32. As will be explained in more detail below, a pneumatic or hydraulic cylinder in assembly 30 forces the end of the stab assembly into receptacle 32 where the stab itself locks into place. A shaft carrying the stab is then withdrawn from the stab by breaking shear pins so that the boom 23 is free from the receptacle 32 on platform 10. As shown in FIG. 3, once the boom 23 is moved safely away from the platform, tension is applied to line 34 to physically tear the receptacle 32, and outer wall and large pieces of equipment coupled to receptacle 32 from the platform 10 to thereby clear a path to the fire site. Once the path has been thus cleared, conventional fire fighting equipment may be employed to cool down the wellhead or other fire site and extinquish the fire.

While vessel 16 is preferably a semi-submersible, as illustrated, other vessels may also be used. Most drillships and many service ships, other than semisubmersibles, could carry an appropriate crane and other necessary equipment. Such conventional ships may be preferred since they may be able to reach the scene of a fire more quickly.

Figures 4, 5, 6:
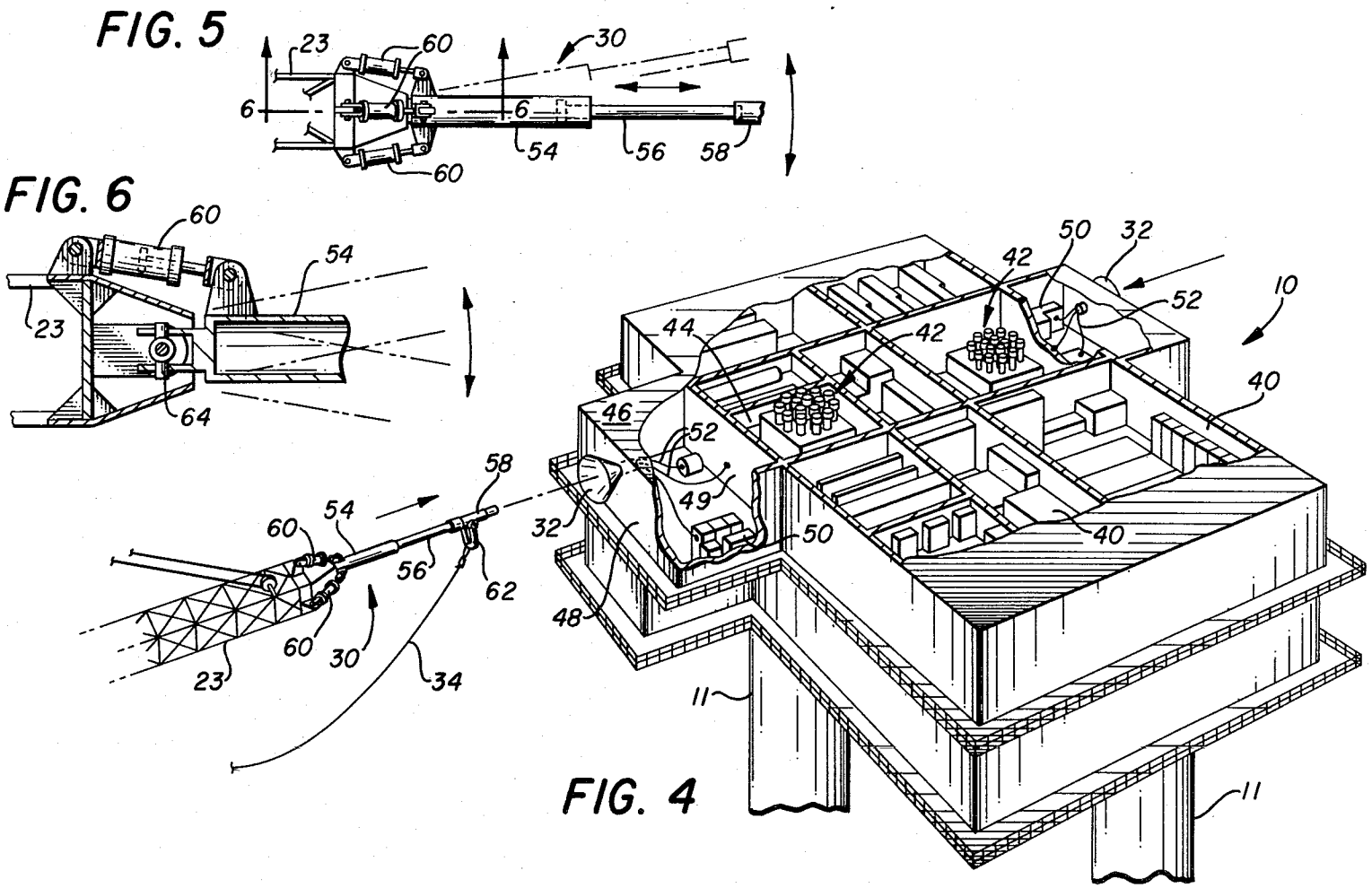
FIG. 4 is a more detailed broken away illustration of an oil platform showing the arrangement of tension lines for removal of walls and heavy equipment within the platform.
FIGS. 5 and 6 are views of control apparatus carried on the end of a crane boom for providing articulation of a stab assembly of the present invention.

With reference now to FIG. 4, more details of platform 10 are shown in a partially broken away view of two lower decks of the platform. Also shown are more details of the end of boom 23 and the stab assembly 30 shown in a position relative to platform 10 which corresponds to the FIG. 1 arrangement. As illustrated, each deck of platform 10 is divided into a number of compartments or rooms 40 for housing various drilling and control equipment. Wellheads 42 are enclosed in a room 44 which is completely surrounded by other compartments such as compartment 40. As noted above, it is necessary to surround the wellhead site in this way due to the limited space available on an oil platform. The wellheads 42 correspond to the site of the fire 14 illustrated in FIGS. 1 through 3. The closest access to wellheads 42 from outside of platform 10 is through the compartment or module 46. Clear access to the wellheads 42 may be obtained only by removal of walls 48 and 49 of room 46 and various pieces of equipment 50 housed in room 46. A stab receptacle is attached to outer wall 48 and is linked by cables 52 to the inner wall 49 and equipment 50 within room 46.

The stab assembly 30 illustrated in FIG. 4 includes control means comprising an actuator portion 54 and extension arm 56 which carries the stab 58. Actuator 54 is pivotally connected to the end of boom 23 and its position is controlled by a plurality of hydraulic cylinders 60. More details of this structure are shown in FIGS. 5 and 6. The stab 58 carries a clevis 62 to which the vessel tension line 34 is attached. Details of this arrangement are shown in FIGS. 7 and 9.

The details of the articulation system for aligning the stab 58 with receptacle 32 is illustrated in FIGS. 5 and 6. The actuator 54 may conveniently comprise a large hydraulic cylinder. The cylinder 54 is connected to the end of boom 23 by a universal joint 64 and its position is controlled by smaller hydraulic cylinders 60 which provide for horizontal or vertical rotation of actuator 54 as shown in FIGS. 5 and 6, respectively. The extension arm 56 is connected to a piston within cylinder 54 and provides axial motion to the stab 58. The connection of stab 58 to extension arm 56 is shown in detail in FIG. 7. The purpose of the articulation arrangement shown in FIGS. 4, 5 and 6 is to provide axial alignment o stab 58 with the receptacle 32 so that they may be properly locked together. It can be seen by reference to FIGS. 1 through 3 that it is unlikely in most cases that the boom 23 itself will be perfectly aligned with the socket in receptacle 32. The universal articulation arrangement allows the control arm 54 to be perfectly aligned so that when the boom 23 positions the stab 58 sufficiently close to receptacle 32, the arm 56 may be extended by hydraulic force to drive the stab 58 home into the socket of receptacle 32.

FIG. 7 illustrates details of stab assembly 30 and receptacle 32. Stab 58 is carried on the end of extension arm 56 held in place by shear pins 66. The shear pins 66 allow the separation of the extension arm 56 from stab 58 when the stab is locked into the receptacle 32. The receptacle 32 comprises a cylindrical socket portion 70 positioned within the wall 48 and a conical guideway 72 positioned outside of the wall. The socket 70 provides a close fit to the end of stab 58 and includes a locking groove 74 designed to mate with a split ring 76 carried on stab 58. The platform tension lines 52 are connected to the end of socket 70 of receptacle 32. In the preferred form, the forward end of stab 58 has an outer diameter of about twelve inches. The largest diameter portion of conical guide 72 preferably has a diameter of eight feet.

FIG. 8 shows the relationship of stab 58 to receptacle 32 after the stab has been anchored into the receptacle, the extension arm 56 has been removed from the stab 58, and the clearing operation has begun by pulling receptacle 32 from wall 58. The clevis 62 is coupled to the stab 58 by a pivot pin 68 so that the clevis may rotate to the position shown in FIG. 8 upon application of tension to line 34. By this arrangement, the tension line 34 is carried to the platform below stab 58 but tension is applied in the clearing operation along the axis of stab 58. While as shown in FIG. 8, the receptacle 32 may literally be torn from wall 48 in the clearing operation, it is preferred that wall 48 be removed as a large single panel. Thus, wall 48 is preferably constructed in the form of a large panel attached to the rest of the structure by shear pins or rivets of sufficient strength to withstand environmental conditions but designed to break and release the wall as a unit when pulled by receptacle 32. In this way, a clear opening would be provided for the removal of the large equipment 50 in the room 46.

While a number of cables 52 are illustrated connecting receptacle 32 to the equipment 50 and wall 49, it may be preferable to use a single cable connected in daisey-chain fashion to each of the elements which are to be cleared away. In either case, it is preferred that the cable lengths be selected so that only one piece of equipment is dislodged from its rest position at a time. The equipment used on oil platforms is typically skid mounted and cables 52 would preferably be coupled to the skids. In this way by properly placing the equipment, it can be pulled across the platform deck fairly easily once anchoring bolts have been sheared. The proper selection of the length of cables 52 will assure that the peak tension available on line 34 will be available to dislodge each piece of equipment.

FIG. 9 shows in cross section the details of the anchoring of stab 58 to receptacle 32. The split ring 76 is shown expanded into groove 74 on the inner surface of receptacle socket 70 to lock stab 58 in place. A compression bolt 78 may be provided on the socket section 70 for compressing the split ring 76 so that stab 58 may be removed from the receptacle if desired.

Figure 10:
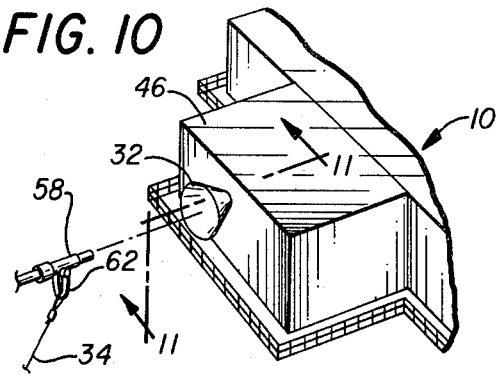
FIG. 10 is an illustration of an alternate tear away platform arrangement.
Figure 12:
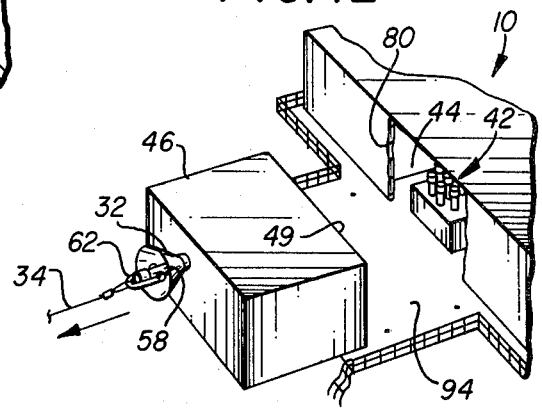
FIG. 12 is an illustration of a modular portion of the FIG. 10 platform being torn away.
Figure 11:
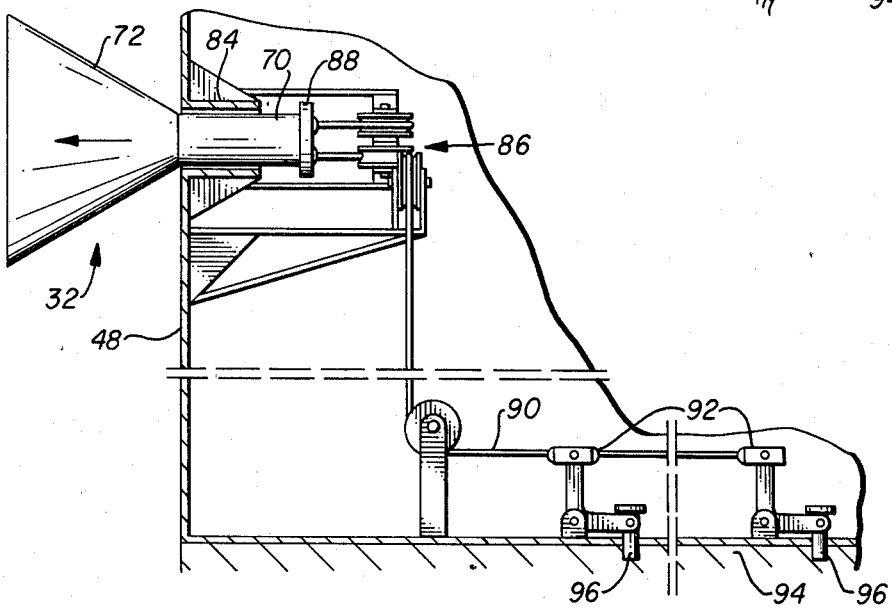
FIG. 11 is a cross sectional illustration of the FIG. 10 embodiment.

FIGS. 10, 11 and 12 illustrate the details of a slightly modified arrangement of platform 10 particularly suited to the clearing apparatus of the present invention. Generally stated, this embodiment provides compartment 46 as a separate unit or module which can be removed from the platform 10 by means of the stab and receptacle apparatus of the present invention. In FIG. 10, the room 46 carries the receptacle 32 and appears externally to be identical to the arrangement illustrated in FIG. 4. But upon insertion of the stab 58 into receptacle 32 and the application of tension to line 34, the entire room 46 including inner wall 49 is pulled from the platform 10 leaving a clear opening 80 into room 44 thereby exposing the wellheads 42.

This arrangement of the equipment in a room or compartment 46 may be particularly suited to oil platform work since the entire compartment may be prefabricated prior to installation on the platform deck during the construction process. In such a case, the entire compartment would be constructed on skids or rails which would be bolted or otherwise pinned to the platform deck.

FIG. 11, in particular, shows a modified receptacle 32 connected to means for positively disengaging compartment 46 from a platform deck. The receptacle 32 includes a cylindrical socket section 70 and a conical guide portion 72 which may be identical to those shown in other figures. But the receptacle 32 is carried in a tubular guide 84 formed in wall 48 instead of being rigidly anchored to the wall. A cable and pulley system 86 is connected to the end of receptacle 32 so that upon the initial appli cation of tensile force to receptacle 32 it moves outwards a distance until a shoulder 88 engages the cylindrical guide 84. The initial motion of the receptacle is transferred by cable 90 to a mechanism 92 for withdrawing anchoring pins from the platform deck 94. By this arrangement pins 96 may be used to anchor the compartment 46 into place on the platform deck and may have sufficient strength to overcome external forces such as those which could be applied by tension line 34. The positive disengagement arrangement allows the pins 96 to be withdrawn so that tension line 34 need apply only enough force to slide the compartment 46 from the platform deck.

Figure 13:
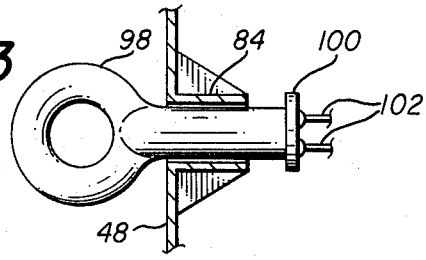
FIG. 13 is a cross sectional illustration of another form of a platform receptacle adaptable for use with the present invention.

With reference now to FIG. 13, there is illustrated a somewhat standard eye 98 which may be used in place of the stab receptacle 32. As illustrated in FIG. 13, the shaft of the eye 98 is carried within a cylindrical guide 84 in the wall 48. The eye 98 carries a shoulder 100 which permits limited motion of the eye in the guide 84 so that cable 102 may be moved sufficiently to release a compartment in the manner illustrated in FIG. 11. An advantage of using eye 98 in place of the stab receptacle 32 is that a standard hook suspended from a boom 23 may engage the eye and thereby be used to clear a path to the fire site. A mechanism for quickly releasing the hook from eye 98 would be preferred to avoid possible damage to the boom 23 as a compartment such as compartment 46 falls into the ocean. Alternatively, a separate hook may be connected to the end of vessel tension line 34 for coupling to eye 98. This hook and line assembly would be carried by the standard hook of boom 23 until it is attached to eye 98. Once attached, the main hook would release the tension line hook and clearing would proceed as discussed above.

Figure 14:
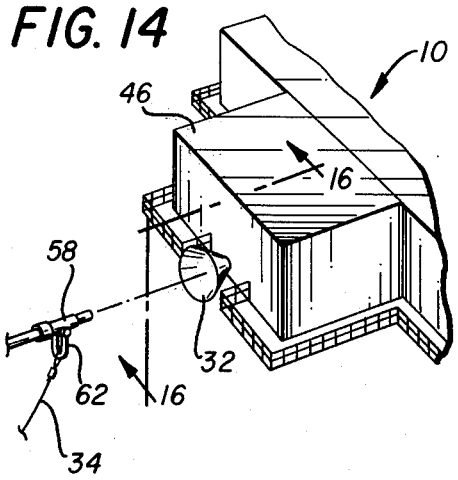
FIGS. 14 and 15 illustrate another embodiment for removal of an entire compartment.
Figure 15:
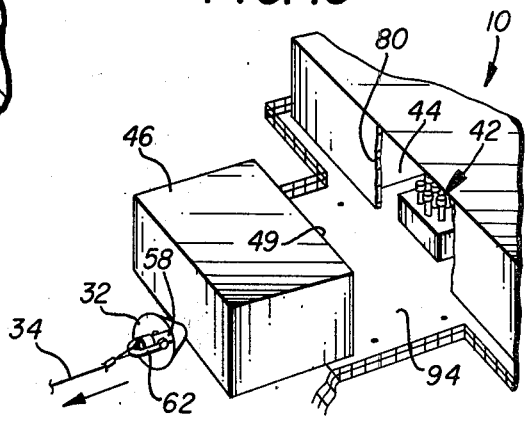
Figure 16:
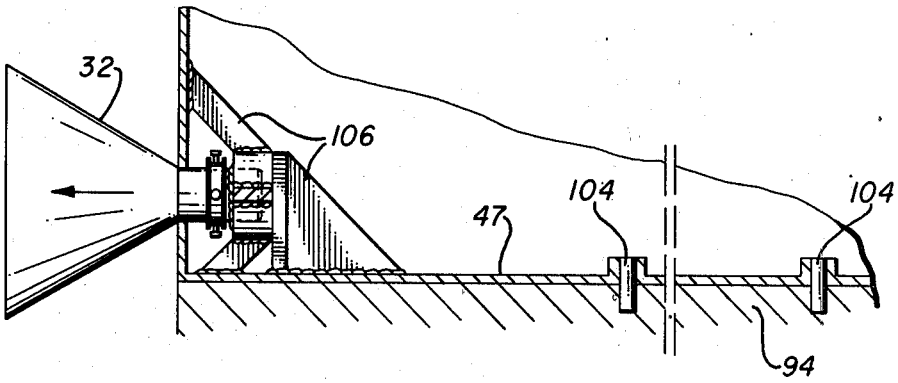
FIG. 16 is a cross sectional illustration of the stab receptacle and a portion of the tear away compartment of FIGS. 14 and 15.

FIGS. 14, 15 and 16 illustrate an alternate arrangement of a tear away compartment. As shown in FIG. 14, the compartment 46 is essentially the same as that shown in the other embodiments. Stab receptacle 32 is also identical except that in FIG. 14 it is positioned very near the floor level of compartment 46. As shown in FIG. 15, this arrangement also provides for tearing away the entire compartment 46 by applying tension to line 34 to provide a clear opening 80 for access to wellheads 42. But in this embodiment, the compartment 46 is attached to the deck 94 by means of shear pins or shear bolts 104 illustrated in FIG. 16. The shear elements 104 arre selected to provide sufficient strength to withstand normal environmental conditions but to shear upon application of tension to line 34. In this way the linkage arrangement illustrated in FIG. 11 are not required to disengage the compartment 46 from deck 94. But since sufficient tension must be transferred from receptacle 32 through the structure of compartment 46, including its floor 47, to not only move the entire structure but to shear the pins 104, the receptacle 32 must be firmly attached to compartment 46 and in particular to the floor 47. Receptacle 32 is mounted near the floor 47 so that it may be effectively coupled directly to the floor and so that the force supplied by tension line 34 will be approximately in alignment with the floor 47. Thus, in FIG. 16, there is illustrated various bracing members 106 connecting receptacle 32 to the floor 47 and outer walls of the compartment 46. While this structure should be very strong, it is actually very simple since it has no moving parts and therefore is very reliable. As illustrated in the FIGS. 14 and 15, this embodiment operates in essentially the same manner as the other embodiments. That is, the stab 58 is locked into receptacle 32 by means of the crane and stab controlling equipment, the crane extension arm is removed from stab 58, and tension is applied to line 34 to clear away the obstructions blocking access to wellheads 42. The primary difference in this embodiment is that the applied tension is used to simply shear the elements which hold compartment 46 in place on deck 94.

Tension may be applied to vessel tension line 34 in a number of ways. With vessel 16 in a fixed position, line 34 may be retrieved by winch 36. Alternatively, vessel 16 may be moved away from platform 10 either by retrieving mooring lines 26 or by use of propulsion units 24. Depending on the amount of force needed for the clearing operation and desired speed of clearing various combinations of these methods may be used.

While the present invention has been shown and illustrated in terms of a particular apparatus and methods, it is apparent that various changes can be made within the scope of the present invention as defined by the appended claims.

What is claimed is:

1. A fire suppression system for use in controlling fires occurring on offshore oil platforms comprising:

a self-propelled service vessel having a means for maintaining said vessel at a predetermined station with respect to said platform;

a stab assembly including a stab adapted to engage a stab receptacle on said platform and means for controlling the movement of said stab;

tension means interconnecting said stab and said vessel;

means extending from said vessel for supporting said stab assembly;

a plurality of walls cooperating to form a compartment for housing operating equipment;

a stab receptacle mounted to said platform, said receptacle including a guide means;

means for locking said stab in said receptacle; and second tension means connecting said equipment to said receptacle, said equipment being removable from said platform by the application of a tensile load to said receptacle.

2. A system for use in controlling fires on an offshore oil platform comprising:

a service vessel including means for maintaining said service vessel at a predetermined position with respect to said platform;

an elongated boom mounted on and movable with respect to said service vessel;

a stab assembly including a stab member mounted on the distal end of said boom, said stab member being adapted to engage a stab receptacle mounted on said platform, said stab member being releasably secured to said boom and including means operable to form a locking engagement between said stab member and said receptacle;

a flexible tension member connected to said stab member and to said service vessel for pulling said stab member, said receptacle and means connected to said receptacle away from said platform in response to a pulling force exerted on said tension member after said stab member has been locked in said receptacle and released from the distal end of said boom.

3. A method for clearing obstructions from an offshore oil platform for fire control purposes comprising the steps of:

connecting said obstruction to a stab receptacle mounted on said platform;

maneuvering a self-propelled service vessel into a position proximate said platform, said vessel including a rotatably mounted crane having a main boom;

attaching a stab assembly to said main boom, said assembly including a stab member, means for positioning said stab member with respect to said boom, and means for releasably securing said stab member to said stab assembly;

connecting a flexible tension member to said stab member and to means on said vessel;

inserting said stab member into said receptacle while substantially maintaining the position of said vessel with respect to said platform;

disengaging said stab member from said stab assembly; and tearing said obstruction free from said platform by tightening said tension member to tear said stab member, said receptacle and said obstruction away from said platform.

4. The method of claim 3 wherein:

said tension member is tightened by anchoring said vessel so as to resist movement of said vessel toward said platform and tightening said tension member with retrieval means mounted on said vessel.

* * * * *